US009970739B2

(12) United States Patent
Muster et al.

(10) Patent No.: US 9,970,739 B2
(45) Date of Patent: May 15, 2018

(54) PROJECTILE WITH REDUCED RICOCHET RISK

(71) Applicant: RUAG AMMOTEC AG, Thun (CH)

(72) Inventors: Michael Muster, Schüpfen (CH); Donald Meyer, Grolley (CH)

(73) Assignee: RUAG AMMOTEC AG, Thun (CH)

( * ) Notice: Subject to any disclaimer, the term of this patent is extended or adjusted under 35 U.S.C. 154(b) by 0 days. days.

(21) Appl. No.: 15/534,990

(22) PCT Filed: Dec. 10, 2015

(86) PCT No.: PCT/EP2015/079198
§ 371 (c)(1),
(2) Date: Jun. 9, 2017

(87) PCT Pub. No.: WO2016/091991
PCT Pub. Date: Jun. 16, 2016

(65) Prior Publication Data

US 2017/0336183 A1 Nov. 23, 2017

(30) Foreign Application Priority Data

Dec. 11, 2014 (EP) ..... 14197363

(51) Int. Cl.
*F42B 10/00* (2006.01)
*F42B 12/00* (2006.01)
(Continued)

(52) U.S. Cl.
CPC ..... *F42B 8/14* (2013.01); *F42B 12/74* (2013.01); *F42B 12/78* (2013.01)

(58) Field of Classification Search
CPC .. F42B 8/14; F42B 12/74; F42B 12/78; F42B 14/06
(Continued)

(56) References Cited

U.S. PATENT DOCUMENTS

2002/0005138 A1 1/2002 Burri
2005/0066848 A1 3/2005 Muskat et al.
(Continued)

FOREIGN PATENT DOCUMENTS

DE 10045009 A1 5/2001
EP 1430266 A1 6/2004
(Continued)

OTHER PUBLICATIONS

International Search Report for PCT/EP2015/078198 dated Feb. 11, 2016; English translation submitted herewith (7 Pages).

*Primary Examiner* — Samir Abdosh
(74) *Attorney, Agent, or Firm* — Fitch, Even, Tabin & Flannery, LLP

(57) ABSTRACT

The invention relates to a projectile (5) with a frangible material, for short-range ammunition. To prevent any significant losses of precision and prevent the internal ballistic loading from being so great that it leads to the destruction of the projectile, it is suggested according to the invention that the projectile (5) consists of a shell (4) made of brass, the shell (4) has, seen in the direction of flight, a front cylindrical receiving space (4*a*) and a rear cylindrical receiving space (4*b*), the two receiving spaces (4*a*, 4*b*) are arranged coaxially with the longitudinal axis (15) of the projectile and are separated from each other by a partition wall (16), the partition wall (16) forms the floor (18) of the front receiving space (4*a*), and a core (1) of a frangible material is inserted in the front receiving space (4*a*), the tip (17) of the core (1) protrudes out of the front receiving space (4*a*), and at least one predetermined breaking point (2), running around the circumference of the shell (4), is formed in the shell (4) in the region of the partition wall (16).

9 Claims, 2 Drawing Sheets

(51) Int. Cl.

| | |
|---|---|
| ***F42B 30/00*** | (2006.01) |
| ***F42B 8/14*** | (2006.01) |
| ***F42B 12/74*** | (2006.01) |
| ***F42B 12/78*** | (2006.01) |

(58) Field of Classification Search
USPC ..... 102/507, 522
See application file for complete search history.

(56) References Cited

U.S. PATENT DOCUMENTS

| | | | |
|---|---|---|---|
| 2010/0224093 | A1 | 9/2010 | Wilhelm et al. |
| 2014/0283707 | A1 | 9/2014 | Reiss |

FOREIGN PATENT DOCUMENTS

| | | | |
|---|---|---|---|
| EP | 2226606 | A2 | 9/2010 |
| WO | 2013/079679 | A1 | 6/2013 |

PROJECTILE WITH REDUCED RICOCHET RISK

CROSS-REFERENCE TO RELATED APPLICATIONS

This application is a U.S. national phase application filed under 35 U.S.C. § 371 of International Application No. PCT/EP2015/079198, filed Dec. 10, 2015, designating the United States, which claims priority from European Patent Application Nos. 14197363.6 and 15171573.7, filed Dec. 11, 2014and Jun. 11, 2015, respectively, which are hereby incorporated herein by reference in their entirety for all purposes.

The invention relates to a projectile which is partly made of a frangible material, for short-range ammunition.

Short-range ammunition has the purpose of enabling the use of larger calibers in smaller training areas. A greater drop in speed is generated by structural measures. This can be realized with a low projectile weight. A further option is a modification of the external projectile geometry. There are various basic principles in this case, such as a reduction of the twist-stabilization (GD) resulting from an aerodynamically unfavorable front or rear end, or a desired pressure reduction over the firing process, thereby reducing the acceleration of the projectile.

Frangibility is a property of special projectiles, and means that the projectile material is designed so that the projectiles fragment into small particles upon impacting hard targets. In German, frangible is translated as "zerbrechbar." The English term, however, is also commonly used in the German language.

Frangible ammunition already exists in an enormous variety. In particular, projectiles with a polymer matrix or with a metal matrix are known. The purpose in this case is the crumbling of the projectile into the smallest possible particles upon impact with a hard surface. The particles have low sectional density. The result is a minimal potential hazard for nearby objects. However, frangible projectiles are relatively difficult to use. For larger calibers, the radial force arising from the spin can result in the projectile bursting in the air.

FIG. 1 shows a cartridge with a frangible projectile 12 according to the prior art. The frangible projectile 12 is inserted into a casing 13, wherein the ogive of the projectile 12 protrudes from the casing 13. After the frangible projectile 12 impacts, by way of example, a steel plate, the frangible projectile 12 breaks apart into dust 14.

The following problems occur with short-range projectiles:

- Short-range projectiles can have significant losses of precision due to the modified geometry.
- Light short-range projectiles demonstrate a problematic reloading behavior, since a consistent recoil is required for the reloading movement.
- If a short-range ricochet occurs, there is a considerable danger for the shooter and for third parties.
- Degradation on the rotor blade or propellers of aircraft and helicopters due to plastic caps discharging.
- Purely frangible projectiles have the problem, in the case of large ammunition types, that the internal ballistic load is so great that it leads to the destruction of the projectile.

The problem addressed by the invention is that of advancing a projectile according to the preamble of claim 1 in such a manner that the aforementioned disadvantages are avoided.

According to the invention, the problem is addressed by a projectile according to the features of claim 1.

Because the projectile consists of a shell made of brass, the shell, viewed in the flight direction, has a front cylindrical receiving space and a rear cylindrical receiving space, both receiving spaces are arranged coaxially with the projectile longitudinal axis and separated from each other by a partition wall, the partition wall forms the floor of the front receiving space, and a core made of a frangible material is inserted into the front receiving space, the core tip protrudes out of the forward receiving space, and at least one predetermined breaking point running around the circumference of the shell is formed in the shell in the region of the partition. Due to the modified geometry there is no loss of precision and the internal ballistic load is not so great that it leads to the destruction of the projectile. In addition, a groove or spiral formed in the front space can have further predetermined breaking points.

In an advantageous embodiment according to the invention, a tracer composition is arranged in the rear receiving space. The rear receiving space lends itself to this, and the tracer composition even desirably shifts the center of gravity slightly toward the rear, thereby improving the flight path.

The core is preferably glued or pressed into the front receiving space. Both are appropriate fixing methods which lead to the desired anchorages.

To direct compressed air away, in particular in the case of press-fitted cores, in an advantageous embodiment the core has bevels or grooves on its outer surface running from the rear end up to the front end of the shell, parallel to the projectile longitudinal axis. In another embodiment, a bore hole is arranged in the partition wall, connecting the front receiving space to the rear receiving space. This also directs the compressed air away. A blind hole with a connection to the front receiving space can also be constructed in the partition wall. This blind hole also functions to reduce pressure.

In a specific embodiment, two circumferential predetermined breaking points running around the circumference of the shell are formed in the shell in the region of the partition, wherein one predetermined breaking point is formed in the rear end of the partition wall, as seen in the direction of flight. The predetermined breaking points are preferably formed at a right angle to the projectile longitudinal axis, and are constructed with a V-shaped or U-shaped cross-section. These predetermined breaking points improve the segmentation behavior.

In a specific embodiment, the inner wall of the front receiving space has one or more notches which are parallel to the projectile axis or run in a spiral. This improves the anchoring of the frangible core in the front receiving space.

The invention is explained in greater detail below with reference to four figures.

Figure 3:
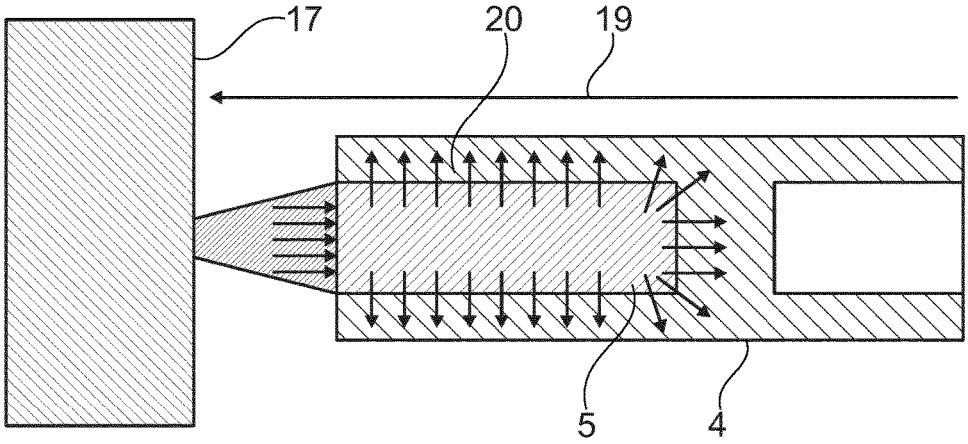
Figure 4:
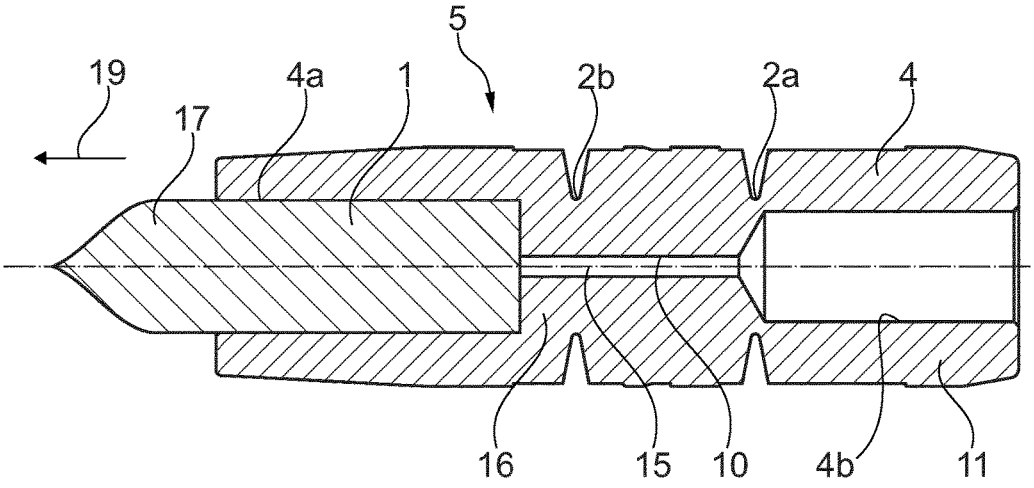

FIG. 3 shows the impact of the mebodiment of the projectile according to the invention against a hard target; and FIG. 4 shows another embodiment of a projectile according to the invention. Both receiving spaces 4*a*, 4*b* are arranged coaxially with the projectile longitudinal axis 15 of the projectile, and are separated from each other by a partition wall 16. The partition wall 16 forms the floor of the receiving space 4*a*. The frangible core is inserted into the front receiving space 4*a*, preferably via a press fit. The front tip 17 of the frangible core 1 projects out of the front receiving space 4*a* and/or the shell 4. A tracer composition (not shown in the figure) is inserted in one embodiment of the invention in the rear receiving space 4*b*. A predetermined breaking point 2 running around the circumference of the shell 4 is formed in the shell 4 adjoining the partition wall 16. This predetermined breaking point 2 is formed at a right angle to the projectile longitudinal axis 15, and can be constructed with a rectangular cross-section, as shown. However, a V-shaped predetermined breaking point 2 is preferred, as shown in FIG. 4.

The external geometry of the projectile, consisting therefore of a frangible core 1 and a shell 4, largely corresponds to a known and proven short-range projectile of the applicant. This meets requirements in terms of precision, loading safety, and trajectory. The risk to the surroundings is reduced by two systems. On the one hand, a core 1 which is made of frangible material is inserted into the shell 4 from the front, as seen in the shooting direction. A "frangible core" means a core which breaks apart—for example, to dust—upon impact with a hard target. On the other hand, predetermined breaking points 2 are introduced into the projectile tail 11 so that the residual mass of the individual parts corresponds at most to the mass of a conventional small-caliber projectile.

The shell 4 of the projectile is preferably made of brass. With brass as the shell, the projectile according to the invention has largely broken apart to dust upon impact. This was surprising for a person skilled in the art, and not predicted. Upon the impact of the projectile 5 against a hard target 17 (see FIG. 3), the frangible core 1 is pressed into the shell 4. During this pressing, the frangible core 1 abruptly produces a high hydrostatic pressure (see arrows 20 in FIG. 3). This causes a splintering of the majority of the projectile. The brass of the shell 4 naturally demonstrates a brittle behavior over such a short stress period. The multiaxial stress state when the frangible core 1 bursts also supports the brittle behavior of the brass of the shell 4. In this way, the impact energy is reduced to an extreme degree, and nearly negated. The rest of the projectile then breaks apart into lighter parts due to the defined predetermined breaking point 2. These individual parts have very low sectional density due to their geometry. This significantly decreases the risk to the surroundings. In a particularly advantageous solution, the frangible core 1 of the projectile is a sub-caliber projectile which is simply inserted into the front receiving space 4*a*. The attachment between the shell 4 and the frangible core 1 can be realized by means of adhesive or a press fit. If a press fit is selected, lateral bevels on the core can direct the compressed air away. A further possibility is that the compressed air is directed away, when the projectile is assembled, by a bore hole in the projectile longitudinal axis 15 through the partition 16, or by a blind bore in the partition wall, so that the pressure can be minimized. The projectile tail 11 is also made of brass, since brass is suitable for press-fitting tracer compositions.

Figure 1:
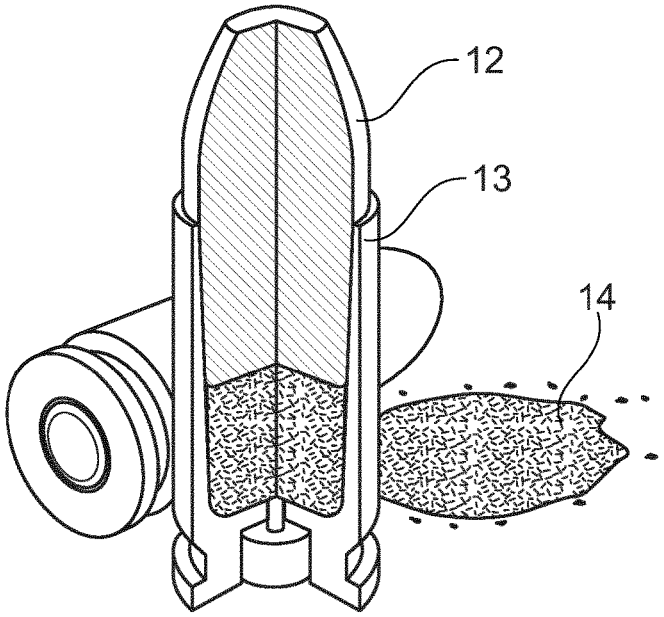
FIG. 1 shows the prior art and is described above.
Figure 2:
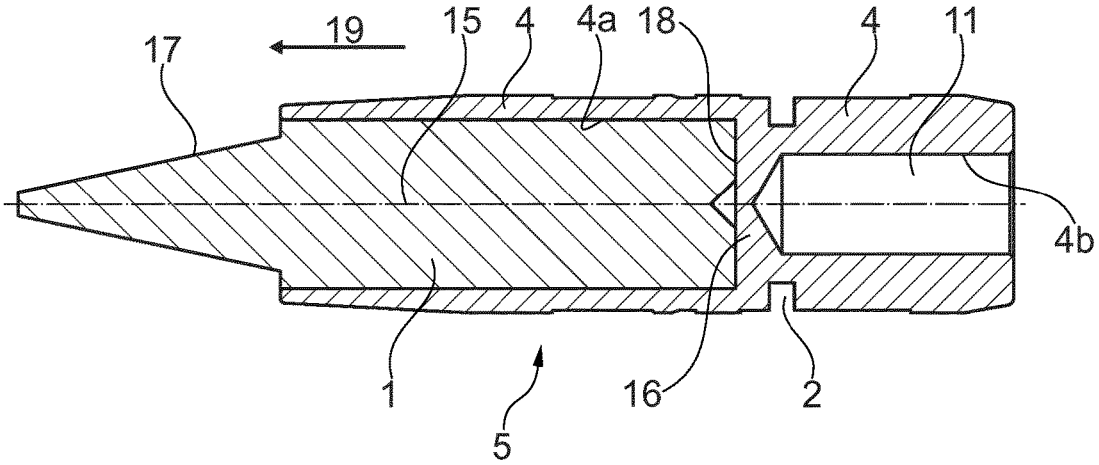
FIG. 2 shows an embodiment of a projectile according to the invention.

FIG. 4 shows another embodiment of a projectile 5 according to the invention, consisting of a shell 4 made of brass and a frangible core 1. The shell 4 has in this case as well, seen in the direction of flight 19, a front 4*a* and a rear cylindrical receiving space 4*b* in the projectile tail 11. The front receiving space 4*a* was inserted from the front, and the rear receiving space 4*b* was inserted from the rear, of the shell 4. Both receiving spaces 4*a*, 4*b* are arranged coaxially with the projectile longitudinal axis 15 of the projectile, and are separated from each other by a partition wall 16. The partition wall 16 in this embodiment is substantially thicker than in the embodiment of FIG. 2. The partition wall 16 in this case also forms the floor of the receiving space 4*a*. The frangible core 1 is inserted into the front receiving space 4*a*, preferably via a press fit. The front tip 17 of the frangible core 1 projects in this case as well out of the front receiving space 4*a* and/or the shell 4. A tracer composition (not shown in the figure) can be inserted in the rear receiving space 4*b*. A predetermined breaking point 2*a* running around the circumference of the shell 4 is formed on the shell 4 adjoining the rear segment—seen in the shooting direction—of the partition wall 16. In the embodiment shown here—also seen in the shooting direction—a predetermined breaking point 2*b* is also formed on the front segment of the partition wall 16. These predetermined breaking points 2*a*, 2*b* are formed at a right angle to the projectile longitudinal axis 15 and are V-shaped in cross-section.

The invention claimed is:

1. A projectile with a frangible material, for short-range ammunition, characterized in that the projectile consists of a shell made of brass, the shell, seen in the direction of flight, has a front cylindrical receiving space and a rear cylindrical receiving space, both receiving spaces are arranged coaxially with the projectile longitudinal axis and are separated from each other by a partition, the partition forms the floor of the front receiving space, and a core made of a frangible material is inserted into the front receiving space, the tip of the core protrudes out of the front receiving space, and at least one predetermined breaking point, running around the circumference of the shell, is formed in the shell in the region of the partition.

2. A projectile according to claim 1, characterized in that a tracer composition is arranged in the rear receiving space.

3. A projectile according to claim 1, wherein the core is glued or pressed into the front receiving space.

4. A projectile according to claim 1, wherein the core has bevels or grooves running parallel to the projectile longitudinal axis on the outer surface from the rear end to the front end of the shell.

5. A projectile according to claim 1, wherein a bore hole which connects the front receiving space to the rear receiving space is arranged in the partition wall.

6. A projectile according to claim 1, wherein a blind bore is inserted into the partition wall and has a connection to the front receiving space.

7. A projectile according to claim 1, wherein two predetermined breaking points running around the circumference of the shell are formed on the shell in the region of the partition wall, wherein one predetermined breaking point is formed in the rear end of the partition wall as seen in the direction of flight.

8. A projectile according to claim 1, wherein the predetermined breaking points are formed at right angles to the projectile longitudinal axis and are V-shaped or U-shaped in cross-section.

9. A projectile according to claim 1, wherein the inner wall of the front receiving space has one or more notches which are parallel to the projectile axis or run in a spiral.

* * * * *